United States Patent [19]

Vincent

[11] 4,104,869

[45] Aug. 8, 1978

[54] STEAM ENGINE WITH STEAM HEAT RECOVERY AND STEAM COMPRESSION

[76] Inventor: Ogden W. Vincent, 2166 La Miel Way, Campbell, Calif. 95008

[21] Appl. No.: 761,350

[22] Filed: Jan. 21, 1977

[51] Int. Cl.[2] ..... F02C 7/00

[52] U.S. Cl. ..... 60/39.55

[58] Field of Search ..... 60/39.05, 39.55, 649, 60/670, 673

[56] References Cited

U.S. PATENT DOCUMENTS

| | | | |
|---|---|---|---|
| 3,657,879 | 4/1972 | Ewbank et al. | 60/39.05 |
| 3,693,347 | 9/1972 | Kydd et al. | 60/39.55 X |
| 3,708,976 | 1/1973 | Berlyn | 60/39.05 X |
| 3,932,987 | 1/1976 | Munzinger | 60/39.05 |
| 3,978,661 | 9/1976 | Cheng | 60/39.55 |

*Primary Examiner*—Allen M. Ostrager

[57] ABSTRACT

This steam engine uses an external combustion chamber where fuel is burned in the presence of air, both under pressure. Steam is forced into the combustion chamber at a medium pressure, thereafter being heated by combustion. Steam from the combustion chamber is released to do work in the engine, the pressure falling. Exhaust stream heat is recovered in a heat exchanger by condensed water which is turned back to steam. This new steam is compressed, after which the steam is injected into the combustion chamber to be heated.

19 Claims, 4 Drawing Figures

STEAM ENGINE WITH STEAM HEAT RECOVERY AND STEAM COMPRESSION

BACKGROUND OF THE INVENTION

There are a great many inventions in the past that use the burning fuel with oxygen in the presence of water, all under pressure. Steam has been produced in this manner for over 100 years to produce a pressurized working fluid for an engine. Some of the earliest inventions are torpedoes which utilize this type of a power plant. The burning of the fuel in the presence of water is an easy way to derive steam under pressure. In almost all of the inventions the constant pressure method is used whereby the fluid is sent to the engine expansion chamber under an almost constant pressure. Then the steam is discharged from the expansion chamber to the atmosphere or is recovered in the form of water by a cooling system. The heat in the exhaust steam is mostly lost in past inventions. Therefore, the water recovered had to be reheated by new fuel in the combustion chamber, which is very costly.

There is another type of invention that is related to the above type invention. This type of invention utilizes an external combustion chamber to heat air with a small amount of water for the production of hot gasses. One of the earliest external combustion engines made no mention of water or steam, and so it was concerned mainly with heating the air accompanying the oxygen. Of course there is always some water vapor in air. Some of the more recent engines utilize a water spray in the air compression chamber, mainly to keep the temperature down. Here the generation of steam is used to keep the engine from burning up. It is well known that temperatures as high as 4000° Fahrenheit are present in an internal combustion engine. These high temperatures are not feasible for external combustion chambers where the fluid is maintained at a constant pressure and temperature. Therefore, water injection is used in more recent inventions in both the air compression cyclinder and the combustion chamber.

In searching the prior art little or nothing was found in the art of turning steam back into steam. There are inventions that produce steam from the exhausts of gas turbines, this steam being used to run a steam turbine. It has been generally accepted that it is uneconomical to try to recompress steam to be used again because the recompression cycle takes as much or more energy than the expansion cycle. Thus, no work would be done. Also, in searching the prior art, there was nothing found about an invention that utilizes a variable pressure steam external combustion chamber. It is true that all combustion chambers experience a fluctuation in pressure. However, the principal of the variable pressure steam external combustion chamber has never been invented or explored, to the knowledge of the inventor. It is well known that the internal combustion chamber must work on the variable pressure motif, and so must the external combustion chamber, if it is combined in some way with the internal chamber or cylinder.

SUMMARY OF THE INVENTION

An external combustion chamber is used wherein saturated steam is admitted at a moderate pressure. This steam is then heated by burning a fuel under pressure in the presence of oxygen under pressure. The superheated steam is then admitted to an expansion chamber, usually a cylinder, where work is done while the combustion chamber remains connected. Then low pressure steam is exhausted from the work means to a pressurized first heat exchanger where most of the heat is exchanged to previously recovered water that turns to steam. Water and steam from the first heat exchanger enter a second heat exchanger where all the remainder steam turns to water. Recovered steam at standard pressure from the first heat exchanger is compressed while water is injected to keep it saturated. The saturated steam at moderate pressure is accumulated to be reinserted into the combustion chamber at the proper time when the pressure there is low. The reinserted steam is then heated, as before, to a high temperature and high pressure under constant volume.

BRIEF DESCRIPTION OF THE DRAWINGS

FIG. 3 is a steam enthalpy-entropy diagram.

FIG. 4 is a pressure-volume diagram of saturated steam.

DETAILED DESCRIPTION

Figure 1:
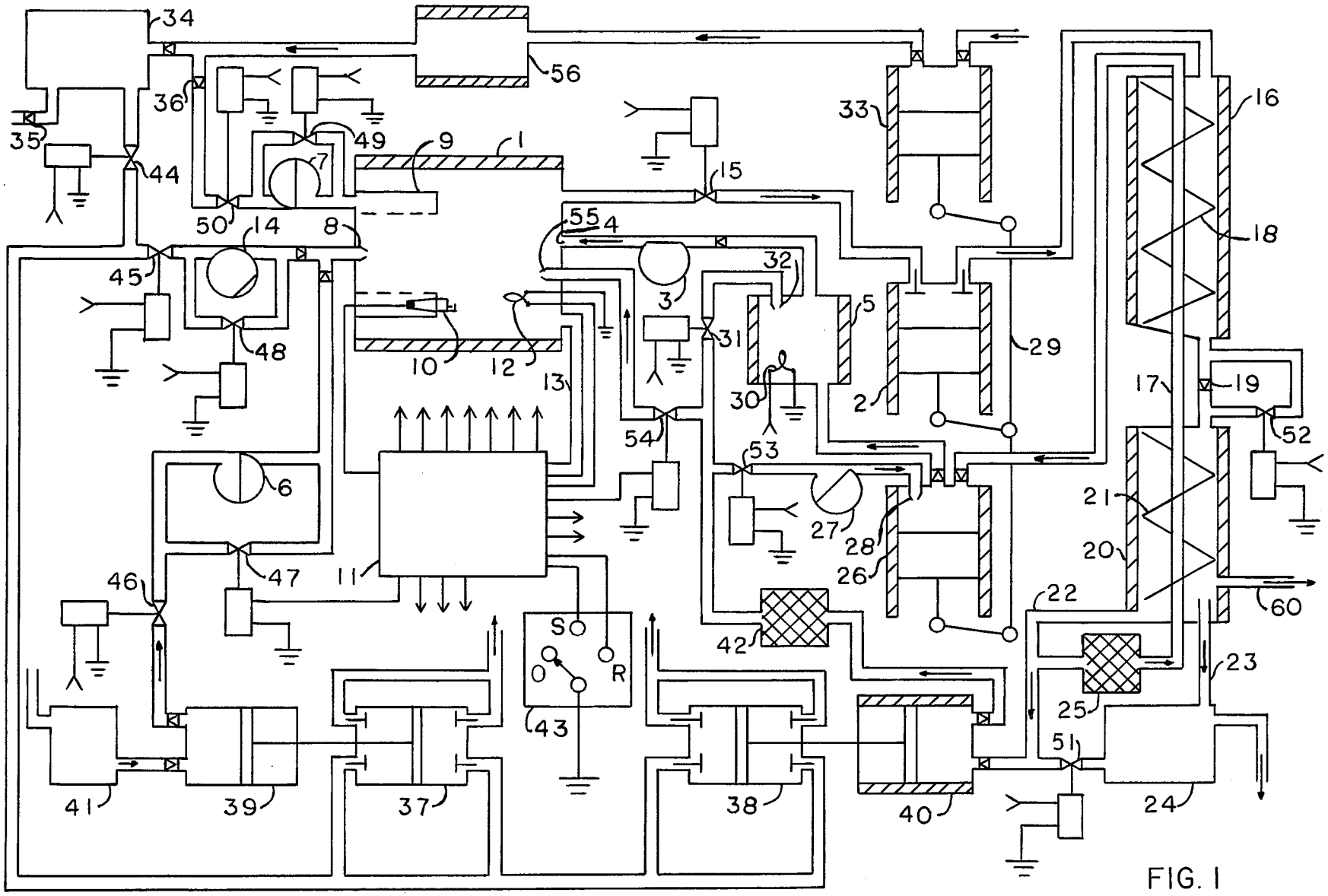
FIG. 1 is a schematic diagram of a steam engine with steam heat recovery and recompression.

The following description describes one example of the invention embodiment. FIG. 1 shows a schematic diagram of the example. Another version is described in a later section, being shown in FIG. 2.

Most of the action centers around combustion chamber 1 which will be described first, even though the engine is a closed circuit. Here combustion chamber 1 is smaller in size than work means or expansion cylinder 2 where the steam does work. A high speed valve 3 synchronized to crankshaft 29 allows saturated steam at a moderate pressure to enter the combustion chamber via a steam port 4 just after the input valve to cylinder 2 closes. At this time the pressure in combustion chamber 1 is low, being the same as the exhaust pressure in cylinder 2. The higher pressure in steam accumulator 5 forces saturated steam into combustion chamber 1. A short time later valve 3 closes. Then high speed valves 6 and 7 open, being synchronized to crankshaft 29. Valve 6 allows fuel under pressure to enter combustion chamber 1 via a fuel injection device or nozzle 8, the fuel being atomized in combustion chamber 1. Valve 7 allows air under pressure to enter combustion chamber 1 via a mixing housing 9 where air mixes with atomized fuel. The fuel-air mixture is ignited by spark plug 10 which is made to continuously spark by electronics control 11. The burning of fuel is continuous in nature and not explosive. A thermistor 12 monitors the temperature in combustion chamber 1, sending a signal to electronics 11. A pressure tube 13 extends the pressure in combustion chamber 1 to a transducer in control 11 where the pressure is monitored. Steam is normally used at temperatures below 1000° F and at pressures between 150 and 200 psia. The temperature of combustion chamber 1 is limited to these conditions, and so the products of combustion are simple combustion products, there being no further chemical reactions due to very high temperatures. The steam and the combustion products mix freely. It takes a very small amount of fuel to heat saturated steam to a high pressure and temperature.

EXPANSION AND HEAT RECOVERY

When the steam in combustion chamber 1 is heated to a high temperature, valves 6 and 7 close and valve 14 opens. Valve 14 is synchronized to crankshaft 29. At the same time the input valve to cylinder 2 opens, allowing gases to enter cylinder 2. Valve 15 is merely used to turn the engine on to run and is usually open. Valve 14 remains open only long enough for air to blow nozzle 8 clean of fuel, preventing burn back. The input valve to cylinder 2 remains open until the piston in cylinder 2 gets to the bottom, at which time the pressure has fallen in both combustion chamber 1 and cylinder 2. The piston in cylinder 2 is attached to a crankshaft 29 via rods. The input valve of cylinder 2 closes and the output valve of cylinder 2 opens. Then the piston in cylinder 2 moves up and pushes the gases out into first heat exchanger 16.

First heat exchanger 16 is maintained at a pressure approximately 15 psi higher than atmospherie so that the saturation temperature is higher than the standard saturation. Valve 19 maintains pressure in exchanger 16. Therefore, heat will flow from the gases in exchanger 16 to recovered water in pipe 17 which goes through the middle of exchanger 16. Gases are forced to take a helical path through exchanger 16 due to helical fin 18 attached to pipe 17. Therefore, the gases are forced to contact the large surface of helical fin 18 to exchange heat. Water that condenses runs down helical fin 18 to valve 19. Water, steam, and exhaust gases flow through valve 19 into second heat exchanger 20 where all the remaining steam condenses at standard pressure. Recovered water flows in pipe 17 through the middle of second heat exchanger 20 which also has a helical fin 21 bonded to it. Water and gases must follow helical fin 21 to exit. The combustion products exit at exhaust pipe 60. Water exits in pipes 22 and 23. Excess water made by the combustion process flow through pipe 23 into auxiliary water tank 24. If tank 24 is full, water is exhausted to the earth by a pipe. Water from pipe 22 goes through filter 25 before entering pipe 17. Water in pipe 17 is heated in first heat exchanger 20 to almost the saturation temperature of second heat exchanger 16. Then the water in pipe 17 changes to steam in second heat exchanger 16.

COMPRESSION OF STEAM

Cylinder 26 is the steam compression cylinder. When the piston in cylinder 26 is at top dead center, the input valve opens, and steam is forced into cylinder 26 by the atmosphere acting through pipe 60. As the piston in cylinder 26 moves downward, steam in pipe 17 is forced in cylinder 26. The piston in cylinder 26 is attached to crankshaft 29 via a rod. At the same time water from pipe 22 is forced into pipe 17, the water level in pipe 17 changing from the top end of exchanger 20 to the top end of exchanger 16.

When the piston in cylinder 26 gets to bottom dead center, the input valve closes. At the same time high speed valve 27 opens allowing water to enter cylinder 26 via a water injection device or nozzle 28 which sprays water into cylinder 26. Valve 27 is synchronized to crankshaft 29. As the piston in cylinder 26 moves upward, steam is compressed, the water from nozzle 28 absorbing the heat of compression. The steam in cylinder 26 is kept near saturation while compression takes place. When the pressure of steam accumulator 5 is reached, the output valve of cylinder 26 opens allowing compressed steam to be forced into steam accumulator 5. When the piston in cylinder 26 reaches top dead center again, the output valve closes. The input valve opens, and valve 27 closes.

Saturated compressed steam is held in steam accumulator 5 for a short time before it is needed for insertion in combustion chamber 1. Steam accumulator 5 maintains the pressure constant between compression strokes. There is a thermistor 30 which monitors the temperature in steam accumulator 5. When the temperature gets above steam saturation temperature at that pressure, valve 31 opens admitting water to injection device or spray nozzle 32. Thus, the steam is kept saturated in steam accumulator 5.

AIR COMPRESSION AND APPARATUS

Air enters the input valve of air cylinder 33 when the piston in cylinder 33 is at top dead center, the piston being attached to crankshaft 29 via a rod. Air is forced into cylinder 33 by the atmosphere as the piston in cylinder 33 moves downward. When the piston in cylinder 33 gets to bottom dead center, the input valve closes, after which the piston moves upwards compressing the air. When the pressure in cylinder 33 exceeds the pressure in air accumulator 56, the output valve of cylinder 33 opens, whereafter air is forced out of cylinder 33 into accumulator 56. Air from accumulator 56 is used to maintain a supply in auxiliary air tank 34. Excess air escapes via pressure relief valve 35. Working air enters the air pipes at valve 36 where it goes to combustion chamber 1, fuel pump motor 37, and water pump motor 38.

Air from either accumulator 56 or tank 34 is used for motivating force in water pump motor 38 and fuel pump motor 37. Valves in motors 37 and 38 are used to direct the air supply, the air being directed to a piston in a cylinder of each motor. The piston in motor 37 exerts force on a shaft connected to the piston in fuel pump 39. The piston in motor 38 exerts force on a shaft connected to the piston in water pump 40. The valve mechanisms for motors 37 and 38 are derived from the piston shaft of each motor, the mechanism not being shown. Used air from motors 37 and 38 is exhausted by exhaust valves to the atmosphere.

FUEL PUMP AND APPARATUS

Fuel is held in fuel tank 41 until needed. When the shaft of the fuel pump 39 moves to the right in FIG. 1, fuel from tank 41 is forced into the cylinder of fuel pump 39 through the input valve by atmospheric pressure. When the piston of cylinder 39 moves to the left in FIG. 1, the input valve closes and the output valve opens, applying pressure to the fuel pipes. Since there is only a small amount of fuel used during one cycle, fuel pump 39 mainly applies pressure to the fuel line. Although a single action pump 39 is shown, a double action pump could also be used to more advantage.

WATER PUMP AND APPARATUS

Water enters the input valve of water pump 40 from either pipe 22 or from auxiliary water tank 24 when the shaft of water pump 40 moves to the left in FIG. 1. Water is forced into the cylinder of water pump 40 by the atmosphere at pipe 60. When the piston of water pump 40 moves to the right in FIG. 1, the input valve closes and the output valve opens, applying pressure to the water output pipe. A water filter 42 is used to remove particles and acids from the water coming out of water pump 40. Since there is only a small amount of water used for each cycle of operation, water pump 40 mainly keeps pressure on the water pipes. Although a single action water pump 40 is shown, a double action pump could also be used to more advantage.

STARTING AND RUNNING ENGINE

The main purpose of the auxiliary air tank 34 and the auxiliary water tank 24 is to start the engine. It can be presumed that pressure in all parts of the system is atmospheric pressure except air tank 34. Auxiliary air tank 34 has air pressure remaining in it to start the engine. When switch 43 is in the off position "O", the following valves are normally closed: 31, 44, 45, 46, 47, 48, 53, and 54. The electrically operated valves controlled by control 11 are as follows: 15, 31, 44, 45, 46, 47, 48, 49, 50, 51, 52, 53, and 54. The following valves are normally open when switch 43 is off: 15, 49, 50, 51, and 52. There is only air in combustion chamber 1, cylinder 2, cylinder 26, accumulator 5, pipe 17 and pipe 22. Any water previously left in parts 16, 17, 18, 19, 20, 21, 22, 25, and 52 is drained off by open valve 51 into tank 24 or to the ground via tank 24.

Switch 43 is moved from the off position "O" to the standby position "S" to start the engine. Logic circuitry in control 11 senses a signal change, closing valves 15 and 52 and opening valves 44, 46, 47, and 48. When valve 44 opens, air goes through valves 49 and 50 into combustion chamber 1, and air goes to motors 37 and 38. When valves 46 and 47 open, fuel under pressure goes to nozzle 8.

Fuel is atomized in combustion chamber 1 by nozzle 8 in the presence of oxygen. The spark from spark plug 10 ignites the fuel, control 11 providing the high voltage pulses for spark plug 10. Combustion follows, heat sensor 12 monitoring the temperature. When the temperature exceeds a predetermined value, valve 54 opens, and water is sprayed in combustion chamber 1 by water injection device or nozzle 55 to produce steam. A transducer in control 11 senses the pressure in chamber 1 through tube 13. When a predetermined pressure is reached, valves 46 and 50 close, and valve 45 opens for a short time to blow residual fuel out of nozzle 8, after which valve 45 closes again. Valve 54 closes when the temperature in chamber 1 reduces to a predetermined valve.

Now combustion chamber 1 has superheated steam in it, enough for turning crankshaft 29 once. It is understood that there may be other cylinders in the engine like 2 with other combustion chambers like 1. There should be at least one more cylinder like 2, to have power on crankshaft 29 at all times. Since there is no pressure in air accumulator 56, cylinder 33 is unloaded initially. Since there is no pressure in steam accumulator 5, cylinder 26 is unloaded initially. The engine must be run unloaded initially until heat exchangers 16 and 20 can reach their operating temperature. Switch 43 is placed in the running position with the engine unloaded. Valves 15, 45, 46, and 50 open. Valves 47, 48 and 49 close. Valve 44 closes after a predetermined time delay. The engine runs automatically then with water being sprayed through nozzles 55 and 32 via valves 54 and 31 respectively. After a short warm-up period, control 11 closes valve 51, and after a short delay opens valve 53, allowing water at pipe 22 to enter pipe 17 to produce steam.

Then the engine is stopped momentarily by switching the switch 43 back to standby "S" while a clutch connects the engine to the load. The engine is put in the run position "R" again where it remains while the engine runs.

To stop the engine switch 43 is placed in the standby "S" position while the load is removed from the engine. The valves assume the positions indicated previously for standby. Then switch 43 is switched to the off "O" position. The valves assume the positions indicated previously for off. Since valve 15 opens, the engine runs until all pressure has left combustion chamber 1. Accumulator 56 loses pressure because valves 49 and 50 are open. Accumulator 5 loses pressure because valve 3 opens periodically. No steam is formed in tube 17 because valve 51 is open. Thus, the engine uses up the steam immediately, thereafter air being drawn in pipe 17 and valve 49, through the combustion chamber 1 and through cylinder 2. The engine purges itself of water and steam before stopping for lack of pressure.

ALTERNATE ENGINE CONFIGURATION

Figure 2:
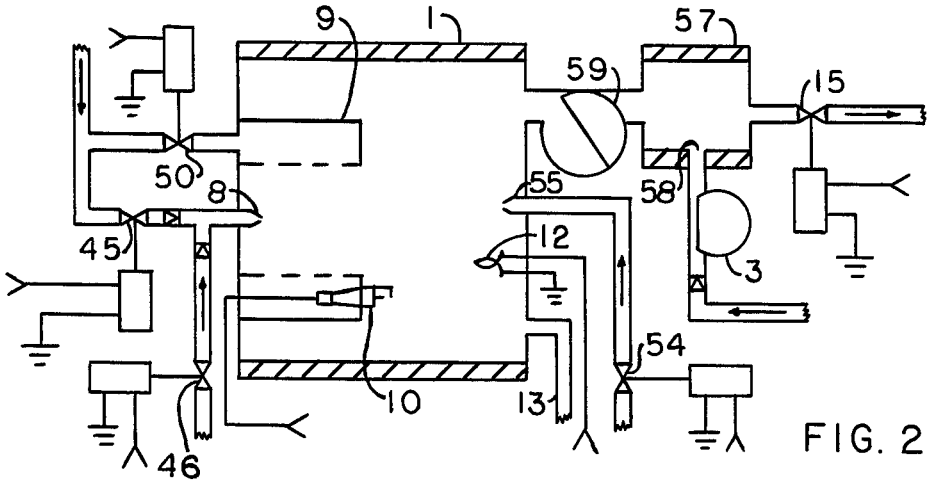
FIG. 2 is a partial schematic diagram of another version of a steam engine with steam heat recovery and recompression.

An alternate engine arrrangement is shown in FIG. 2 where only the changes to FIG. 1 are shown. Since burning is continuous in the alternate engine arrangement, the following valves shown in FIG. 1 are deleted: 6, 7, 14, 47, 48, and 49. The valve arrangement is simplified. Here combustion chamber 1 is larger than cylinder 2, being large enough to accommodate the combustion for all the cylinders like 2 in the engine. The functions of valves 45, 46, and 50 are the same as in FIG. 1. The start up procedure is the same as in FIG. 1. Valve 54 opens and water is sprayed through nozzle 55 when the temperature in chamber 1 exceeds a predetermined value. The functions of spark plug 10, thermistor 12 and tube 13 are the same as in FIG. 1. During running of the engine, valves 46 and 50 are open, allowing fuel to be injected through nozzle 8 and oxygen to be injected through mixing housing 9. Combustion is continuous. Valve 54 opens occasionally to spray water through nozzle 55 into combustion chamber 1 to prevent excessive temperatures. Valves 46 and 50 close automatically if a predetermined temperature is exceeded in chamber 1. Valve 3 functions the same as in FIG. 1 but here valve 3 admits medium pressure saturated steam from steam accumulator 5 to a small mixing vessel 57 via steam port 58. For each cylinder 2 of the engine there is a mixing vessel 57, a valve 59, a valve 15, and a valve 3. Valve 3 opens for a short time just after the input valve to cylinder 2 closes, the pressure being low in vessel 57. Valve 59 is closed at this time. The pressure in vessel 57 becomes the pressure of accumulator 5 very quickly. Immediately after valve 3 closes, valve 59 opens allowing heated steam and gases to enter vessel 57 from chamber 1. Valve 59 stays open for almost half a cycle, allowing the gases in vessel 57 to mix with gases in chamber 1. The cool steam in vessel 57 is heated, and the hot steam in chamber 1 is cooled slightly.

When the piston in cylinder 2 reaches top dead center, the input valve opens and the output valve closes. Then valve 59 closes. Since valve 15 is always open while running, gases from vessel 57 enter cylinder 2, pushing the piston in cylinder 2 downward to do work. When the piston in cylinder 2 reaches bottom dead center, the input valve closes and the output valve opens, the pressure being low in both cylinder 2 and vessel 57. Gases remaining in cylinder 2 are exhausted on the up stroke to first heat exchanger 16, as in FIG. 1. All other parts and functions are the same as in FIG. 1.

The main advantage of the alternate engine configuration is simplicity in construction. Also, burning is continuous in combustion chamber 1, allowing more time for burning to be completed. There is only one combustion chamber 1 which can be located a greater distance from cylinder 2. The main disadvantage is that diffusion of the gases between vessel 57 and chamber 1 will not be complete, and water spray is needed occasionally in chamber 1.

THEORY OF OPERATION

Figure 3:
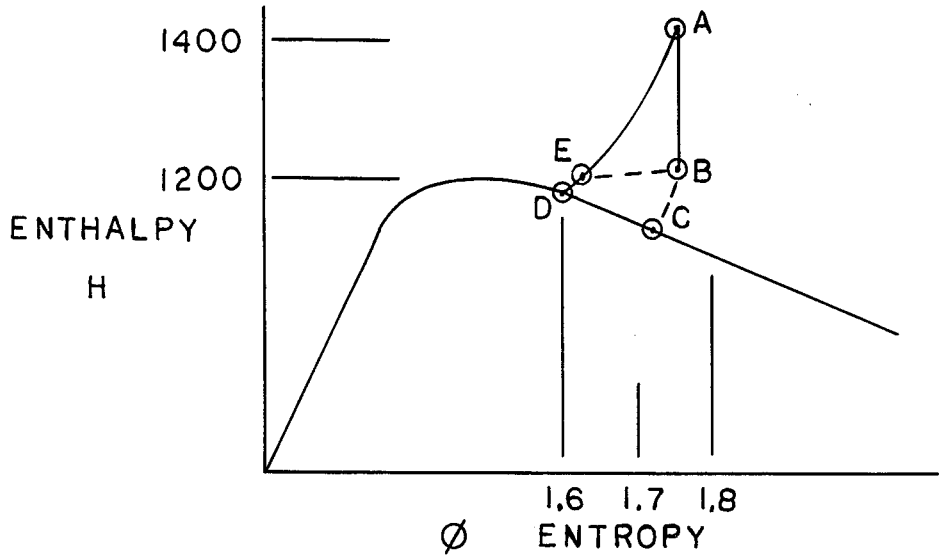
FIG. 3 is a graph which shows an example of the process followed by the invention.

The following description is an example used to explain the theory of operation. Refer to FIG. 3 which is a small copy of *A Mollier Chart Of The Properties Of Steam* upon which is drawn the cycle of the engine. Steam at high pressure and temperature enters cylinder 2, being at point A which is 770° F and 160 psia. The steam expands in cylinder 2 and does work, progressing to point B. Steam left in combustion chamber 1 of FIG. 1 or in vessel 57 of FIG. 2 is also at point B which is 375° F and 30 psia. The work done by a pound of steam is 1415 − 1225 = 190 BTU. There is 0.28 pound of steam left in combustion chamber 1 or vessel 57 when the input valve of cylinder 2 closes. The residual air is 0.16 pound of N2 and CO2 which does 11 BTU of work, expanding adiabatically in cylinder 2 along with the steam between 770° and 375°. The piston in cylinder 2 does 201 BTU of work.

Figure 4:
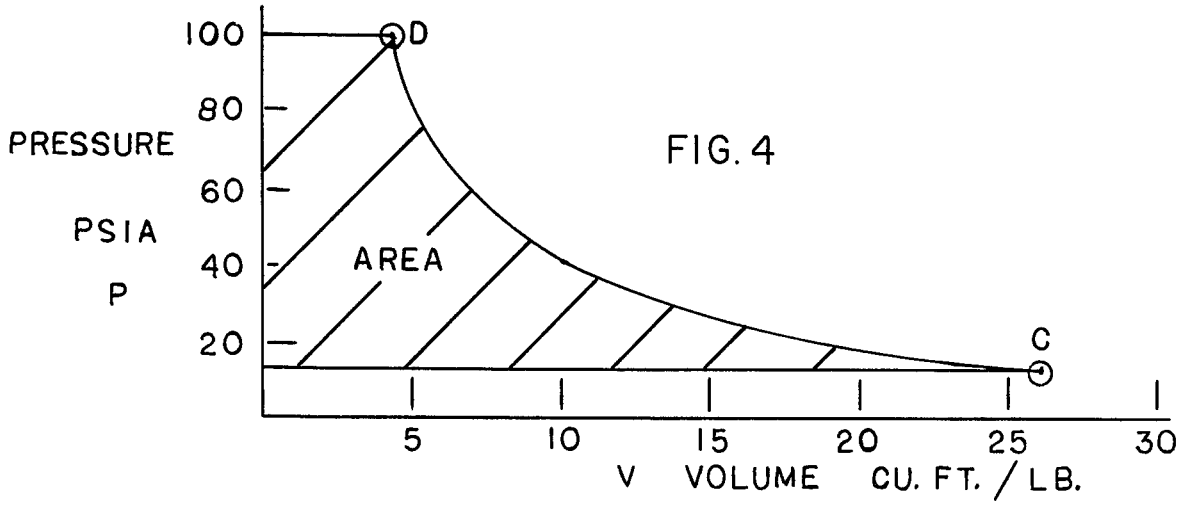
FIG. 4 is a graph which shows an example of the recompression of saturated steam.

The steam from pipe 17 enters piston 26 after obtaining heat from exhaust gases, being shown at point C which is 212° F and 14.7 psia. However, only 0.72 pound of steam need be compressed because 0.28 pound of steam remains in combustion chamber 1 or vessel 57. Compression takes place between points C and D in FIG. 3. The heat of compression is absorbed by water which is sprayed by nozzle 28. This steam is compressed to 100 psia and 327° F, being point D. The work of compression is obtained by taking the area in FIG. 4 and by multiplying by 0.72 pound which gives 106 BTU done by the piston in cylinder 26. 0.11 pound of water is required by nozzle 28 to absorb the heat of compression, meaning only 0.61 pound of steam is required from pipe 17. Therefore, 106 BTU is a high estimate for the work of steam compression.

Air is compressed adiabotically in cylinder 33 from 14.7 psia to 180 psia. 0.16 pound of air is needed to obtain oxygen. It is assumed that kerosene is the fuel being burned in the presence of air, requiring 13.1 pounds of air per pound of fuel. It is calculated that 22 BTU are required for air compression. The air retains the heat of compression when it enters combustion chamber 1. After the fuel burns, 0.126 pound of nitrogen, 0.034 pound of carbon dioxide and 0.015 pound of water vapor are residual products. Through a series of approximations it is estimated that 0.0125 pound of kerosene is needed to heat the gases in combustion chamber 1 for a total heat of 243 BTU per pound of steam plus residual products.

The steam left in combustion chamber 1 or vessel 57 is at point B in FIG. 3. The steam in accumulator 5 is at point D. When steam from accumulator 5 enters chamber 1 or vessel 57, diffusion takes place in a process of free expansion, there being no work done because the molecules are considered far apart from one another. Therefore, 0.27 pounds of residual steam at point B mix with 0.73 pounds of steam at point D to climb up on the constant pressure line of 100 psia to point E. Point E enthalpy is estimated as 1197 BTU per pound. The steam in combustion chamber 1 or vessel 57 is heated. The steam in combustion chamber 1 is heated at constant volume from point E to point A. The steam in vessel 57 is heated by a mixing action of free expansion, the end product being the same.

The main object in adopting this type of engine is primarily economy. Another object is a cool operating engine with clean combustion. This engine is smooth running and quiet because there are no explosions as in the internal combustion engine. From the figures given above the total work of compression for both steam and air is 128 BTU. The work of compressing the water and fuel is small and is not counted. The total heat input is 243 BTU, and the total work or available energy for outside use is 73 BTU, which presumes no mechanical friction, fluid friction, leakage, turbulence, or heat transfer. Therefore, the following parts are shown insulated in FIG. 1 and FIG. 2: combustion chamber 1, cylinder 2, cylinder 33, cylinder 26, water pump 40, first heat exchanger 16, second heat exchanger 20, air accumulator 56, steam accumulator 5, and vessel 57. Other interconnecting parts are insulated also. The total theoretical efficiency is 73 BTU divided by 243 BTU or 30%.

It is to be understood that the embodiment described herein is merely illustrative of the principles of the invention. Various modifications thereto may be effected by persons skilled in the art without departing from the spirit and scope of the invention.

What is claimed is:

1. A steam engine comprising:

a pressurized combustion chamber means having a fuel injection device for injecting pressurized fuel, said chamber means having an oxygen port for injection of an oxygen bearing pressurized gas for oxidizing the fuel during combustion, a fuel igniting element producing heat, said chamber means having an output port, said chamber means having a water injection device for injecting pressurized water, said chamber means having a temperature sensing element and having a pressure port which is connected to a transducer via a first pipe, said chamber means having a steam port connected to the output port of a steam accumulator via a second pipe and valves for steam injection, a work means having an input that is connected to the output port of said chamber means via a third pipe and valves, said work means doing work by gas expansion, thereby transmitting work by a drive shaft, the output of said work means exhausting gases to the gas input of a heat exchanger means via a fourth pipe, said heat exchanger means with a gas input port conducting heat from input gases to recovered water, thereby water condensing for a water output, said exchanger means exhausting waste gases to the atmosphere via an exhaust pipe, for a steam output said exchanger means heating recovered input water with input gases, a steam compressor means having an output and having an input which is connected to the steam output of said exchanger means, said steam compressor means having a water injection device for the injection of pressurized water during compression, said compressor means receiving motivation energy from said drive shaft, said pressurized steam accumulator means having an output port and having an input port which is connected to the output of said steam compressor means, an air compressor means having an input connected to the atmosphere and an output connected to an air accumulator, said air compressor means receiving motivation energy from said drive shaft, the output of said air accumulator being connected to an auxiliary air tank and to said chamber means via a fifth pipe and valves, a pressure producing fuel pump means having an input connected to a fuel tank, the output of said fuel pump means being connected to said fuel injection device via a sixth pipe and valves, said fuel pump means receiving motivation energy from said work means, a pressure producing water pump means having an input at atmospheric pressure connected by a seventh pipe and valves to the water output of said heat exchanger means and to the output of an auxiliary water tank, the output of said water pump means being connected via an eighth pipe, a first filter, and valves to a plurality of water injection devices, said water pump means receiving motivation energy from said work means, and an electro-mechanical control means using electronic and mechanical signals from components as input signals, said control means operating a plurality of valves in pipe lines, said control means generating output electronic signals and mechanical functions to control engine functions.

2. The engine of claim 1 wherein said combustion chamber means comprises a gas valve in said second pipe being synchronized to said drive shaft, thereby opening periodically to inject steam in the steam port of said chamber means, whereafter the pressure increases during steam injection, a fuel valve in said sixth pipe to said fuel injection device being synchronized to said drive shaft, thereby opening periodically for fuel injection, a water injection valve from said eighth pipe opening in response to excess temperature, a gas pipe valve from said fifth pipe being synchronized to said drive shaft, thereby opening periodically for injection of oxygen or air in said oxygen port in synchronism with fuel injection, a valve from said fifth pipe in the gas input to said fuel injection device being synchronized to said drive shaft, thereby opening periodically for the removal of residual fuel, and an output valve in said third pipe opening to run the engine.

3. The engine of claim 2 wherein said work means comprises at least one piston in a cylinder connected to said drive shaft via connecting links, at least one input valve synchronized to said drive shaft, thereby opening periodically for input gases to do work on at least one piston, and at least one output valve synchronized to said drive shaft, thereby opening periodically for gases to be forced out by piston force.

4. The engine of claim 3 wherein said heat exchanger means comprises a first heat exchanger at above atmospheric pressure having at least one chamber with at least one pressure maintaining valve, wherein input gases conduct heat to input water in a ninth pipe to make steam, an output gas port exhausting gases and water via a tenth pipe and valves to the gas input of a second heat exchanger, and said second heat exchanger at atmospheric pressure having at least one chamber, wherein input gases and water conduct heat to recovered water in a continuation of said ninth pipe, a water inlet to said ninth pipe being connected to the reclaimed water outlet via a second filter, an exhaust pipe exhausting gases to the atmosphere, a water overflow pipe exhausting excess water, the water output of said second heat exchanger joining the water input of said first heat exchanger by a continuation of said ninth pipe.

5. The engine of claim 4 wherein said steam compressor means comprises at least one piston in a cylinder connected to said drive shaft via connecting links, whereby steam is compressed, at least one steam input valve opening by atmospheric pressure, whereby output steam from said first heat exchanger enters a cylinder, at least one steam output valve opening by cylinder steam pressure, a water valve from said eighth pipe to water injection devices being synchronized to said drive shaft, thereby opening periodically during compression, and at least one water injection device injecting water into a cylinder.

6. The engine of claim 5 wherein said air compressor means comprises at least one piston in a cylinder connected to said drive shaft via connecting links, whereby air is compressed, at least one air input valve opening to a cylinder by input atmospheric pressure, and at least one air output valve opening to an output by cylinder pressure.

7. The engine of claim 6 wherein said steam accumulator means comprises a pressurized vessel having a water injection device for injecting pressurized water, a heat sensitive electronic element making an electronic signal in response to steam temperature, and a water injection valve from said eighth pipe being controlled in response to excess steam temperature.

8. The engine of claim 7 wherein said conrol means comprises a function switch generating electronic signals, electronics controlling gas valves in pipe to said oxygen port, electronics controlling valves in gas pipe to said fuel injection device, electronics controlling valves in fuel pipe to said fuel injection device, electronics controlling the water injection valve of said chamber means, electronics controlling the water injection valve of said steam accumulator means, electronics controlling a bypass valve between said first and second heat exchangers, electronics controlling the output valve of said water tank, electronics controlling an input valve to said work means, electronics producing high voltage pulses for said ignition device, and electronics controlling a water valve to aid steam compressor means.

9. The engine of claim 7 wherein said control means includes a function switch generating function signals, input signals being generated by pressure transducers and temperature sensors located throughout said engine, electronic circuitry operating on said function and input signals, thereby producing output signals that control electric pipe valves, and said circuitry generating high voltage pulses for said ignition device.

10. A steam engine comprising:

a pressurized combustion chamber means having a fuel injection device for injecting pressurized fuel, said chamber means having an oxygen port for injection of an oxygen bearing pressurized gas for oxidizing the fuel during combustion, a fuel igniting element producing heat, said chamber means having an output port connected to the input port of a steam mixing means by a combining tube and a valve, said chamber means having a water injection device for injecting pressurized water, said chamber means having a temperature sensing element and having a pressure port which is connected to a transducer via a first pipe, said steam mixing means being a pressurized vessel with an input port, an output port, and a steam port which is connected to the output port of a steam accumulator means via a second pipe and valves, said mixing means mixing gases from said chamber means with preinjected steam from said steam accumulator means, a work means having an input that is connected to the output port of said mixing means by a third pipe and valve, said work means doing work by gas expansion, thereby transmitting work via a drive shaft, the output of said work means exhausting gases to the gas input of a heat exchanger means via a fourth pipe, said heat exchanger means with a gas input port conducting heat from input gases to recovered water, thereby water condensing for a water output, said exchanger means exhausting waste gases to the atmosphere via an exhaust pipe, for a steam output said exchanger means heating recovered input water with input gases.

a steam compressor means having an output and having an input which is connected to the steam output of said exchanger means, said steam compressor means having a water injection device for the injection of pressurized water during compression, said steam compressor means receiving motivation energy from said drive shaft, said pressurized steam accumulator means having an output port and having an input port which is connected to the output of said steam compressor means, an air compressor means having an input connected to the atmosphere and an output connected to an air accumulator, said air compressor means receiving motivation energy from said drive shaft, the output of said air accumulator being connected to an auxiliary air tank and to said chamber means via a fifth pipe and valves, a pressure producing fuel pump means having an input connected to a fuel tank, the output of said fuel pump means being connected to said fuel injection device via a sixth pipe and valves, said fuel pump means receiving motivation energy from said work means, a pressure producing water pump means having an input at atmospheric pressure connected by a seventh pipe and valves to the water output of said heat exchanger means and to the output of an auxiliary water tank, the output of said water pump means being connected via an eighth pipe, first filter and valves to a plurality of water injection devices, said water pump means receiving motivation energy from said work means, and an electro-mechanical control means using electronic and mechanical signals from components as input signals, said control means operating a plurality of valves in pipe lines, said control means generating output electronic signals and mechanical functions to control engine functions.

11. The engine of claim 10 wherein said combustion chamber means comprises a fuel valve in said sixth pipe to said fuel injection device being controlled to allow continuous fuel injection, thereafter fuel injection stopping when a predetermined chamber pressure is reached, a gas valve from said fifth pipe to said oxygen port opening when fuel is injected, a valve from said fifth pipe in the gas input to said fuel injection device opening for a short time after fuel injection stops, and a water injection valve from said eighth pipe opening in response to excess temperature.

12. The engine of claim 11 wherein said mixing means comprises a valve in said second pipe to the steam port of said mixing means being synchronized to said drive shaft, thereby opening periodically for steam injection, a valve in said combining tube to the input port of said mixing means being synchronized to said drive shaft, thereby opening periodically after steam injection to allow gas mixing, and an output valve in said third pipe opening to run the engine.

13. The engine of claim 12 wherein said work means comprises at least one piston in a cylinder connected to said drive shaft via connecting links, at least one input valve synchronized to said drive shaft, thereby opening periodically for input gases to do work on pistons, and at least one output valve synchronized to said drive shaft, thereby opening periodically for gases to be forced out by piston force.

14. The engine of claim 13 wherein said heat exchanger means comprises a first heat exchanger at above atmospheric pressure having at least one chamber with at least one pressure maintaining valve, wherein input gases conduct heat to input water in a ninth pipe to make steam, an output gas port exhausting gases and water via a tenth pipe and valves to the gas input of a second heat exchanger, and said second heat exchanger at atmospheric pressure having at least one chamber, wherein input gases and water conduct heat to water in a continuation of said ninth pipe, a water inlet to said ninth pipe being connected to the reclaimed water outlet via a second filter and, an exhaust pipe exhausting gases to the atmosphere, a water overflow pipe exhausting excess water, the water output of said second heat exchanger joining the water input of said first heat exchanger by a continuation of said ninth pipe.

15. The engine of claim 14 wherein said steam compressor means comprises at least one piston in a cylinder connected to said drive shaft via connecting links, at least one steam input valve opening by atmospheric pressure, at least one steam output valve opening by cylinder pressure, a water valve from said eighth pipe to water injection devices being synchronized to said drive shaft, thereby opening periodically during compression, and at least one water injection device injecting water in a cylinder.

16. The engine of claim 15 wherein said air compressor means comprises at least one piston in a cylinder connected to said drive shaft via connecting links, at least one air input valve opening by input pressure, and at least one air output valve opening by cylinder pressure.

17. The engine of claim 16 wherein said steam accumulator means comprises a pressurized vessel having a water injection device for injecting pressurized water, a heat sensitive device signaling in response to temperature, and a water injection valve from said eighth pipe opening in response to excess steam temperature.

18. The engine of claim 17 wherein said control means comprises a function switch generating electronic signals, electronics controlling a gas valve in pipe to said oxygen port, electronics controlling valves in gas pipe to said fuel injection device, electronics controlling a valve in fuel pipe to said fuel injection device, electronics controlling the water injection valve of said chamber means, electronics controlling the water injection valve of said steam accumulator means, electronics controlling a bypass valve between said first and second heat exchangers, electronics controlling the output valve of said water tank, electronics controlling the input valve of said work means, electronics producing high voltage pulses for said ignition device, and electronics controlling a water valve to said steam compressor means.

19. The engine of claim 17 wherein said control means includes a function switch generating function signals, input signals being generated by pressure transducers and temperature sensors located throughout said engine, electronic circuitry operating on said function and input signals, thereby producing output signals that control electric pipe valves, and said circuitry generating high voltage pulses for said ignition device.

* * * * *